US009222036B2

(12) United States Patent
Touzalin et al.

(10) Patent No.: US 9,222,036 B2
(45) Date of Patent: Dec. 29, 2015

(54) PROCESS FOR THE PRODUCTION OF A GASOLINE WITH A LOW SULFUR CONTENT

(71) Applicant: IFP Energies nouvelles, Rueil-Malmaison (FR)

(72) Inventors: Olivier Touzalin, Lyons (FR); Philibert Leflaive, Mions (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 183 days.

(21) Appl. No.: 14/150,815

(22) Filed: Jan. 9, 2014

(65) Prior Publication Data

US 2014/0197073 A1 Jul. 17, 2014

(30) Foreign Application Priority Data

Jan. 14, 2013 (FR) ..... 13 00065

(51) Int. Cl.

| | |
|---|---|
| ***C10G 65/04*** | (2006.01) |
| ***C10G 45/08*** | (2006.01) |
| ***C10G 45/10*** | (2006.01) |
| ***C10G 25/11*** | (2006.01) |
| ***C10G 45/04*** | (2006.01) |
| ***C10G 45/06*** | (2006.01) |

(Continued)

(52) U.S. Cl.

CPC *C10G 45/10* (2013.01); *C10G 7/00* (2013.01); *C10G 25/11* (2013.01); *C10G 45/04* (2013.01); *C10G 45/06* (2013.01); *C10G 45/36* (2013.01); *C10G 45/40* (2013.01); *C10G 53/02* (2013.01); *C10G 65/04* (2013.01); *C10G 65/06* (2013.01); *C10G 67/02* (2013.01); *C10G 69/04* (2013.01); *C10G 2300/104* (2013.01); *C10G 2300/1044* (2013.01); *C10G 2300/202* (2013.01); *C10G 2300/4087* (2013.01); *C10G 2400/02* (2013.01)

(58) Field of Classification Search

CPC ..... C10G 65/04; C10G 45/08; C10G 45/10

See application file for complete search history.

(56) References Cited

U.S. PATENT DOCUMENTS

| | | | | |
|---|---|---|---|---|
| 5,837,130 | A | 11/1998 | Crossland | |
| 6,444,118 | B1 * | 9/2002 | Podrebarac | C10G 45/00 203/DIG. 6 |

(Continued)

OTHER PUBLICATIONS

Search Report from Priority Patent Application No. FR 13/00065 dated Oct. 11, 2013.

*Primary Examiner* — Randy Boyer

(74) *Attorney, Agent, or Firm* — Millen, White, Zelano & Branigan, P.C.

(57) ABSTRACT

This invention relates to a process for treatment of a gasoline comprising diolefins, olefins, and sulfur-containing compounds including mercaptans, in which:

Gasoline is injected into a distillation column comprising at least one reaction zone to produce a desulfurized light gasoline;

with the process also comprising the following stages:

An intermediate gasoline fraction is drawn off at a level located above the reaction zone;

A heavy gasoline comprising the majority of the sulfur-containing compounds is drawn off at the bottom of the column;

In a demercaptization reactor, said intermediate gasoline fraction is brought into contact with a second catalyst to produce an effluent that contains sulfides;

The effluent that is obtained from the demercaptization reactor is recycled in the distillation column (3).

13 Claims, 2 Drawing Sheets

(51) Int. Cl.

| | |
|---|---|
| ***C10G 45/36*** | (2006.01) |
| ***C10G 45/40*** | (2006.01) |
| ***C10G 53/02*** | (2006.01) |
| ***C10G 65/06*** | (2006.01) |
| ***C10G 67/02*** | (2006.01) |
| ***C10G 69/04*** | (2006.01) |
| ***C10G 7/00*** | (2006.01) |

(56) References Cited

U.S. PATENT DOCUMENTS

| | | | | |
|---|---|---|---|---|
| 6,824,676 | B1 | 11/2004 | Podrebarac et al. | |
| 7,351,327 | B2 | 4/2008 | Podrebarac et al. | |
| 2004/0178123 | A1* | 9/2004 | Podrebarac ..... | C10G 67/06 208/211 |
| 2004/0195151 | A1 | 10/2004 | Podrebarac et al. | |

* cited by examiner

PROCESS FOR THE PRODUCTION OF A GASOLINE WITH A LOW SULFUR CONTENT

This invention relates to a process for treatment of a gasoline comprising diolefins, olefins, and sulfur-containing compounds including mercaptans for the purpose of providing a light fraction of this gasoline with a very low sulfur content while preserving the octane number.

STATE OF THE ART

The production of reformulated gasolines meeting the new environmental standards requires in particular that their concentration of olefins be slightly reduced but their concentration of aromatic compounds (primarily benzene) and sulfur be significantly reduced. The catalytic cracking gasolines, which can represent 30 to 50% of the gasoline pool, have high olefin and sulfur contents. The sulfur that is present in the reformulated gasolines can be nearly 90%, attributed to the catalytic cracking gasoline (FCC, "Fluid Catalytic Cracking," or catalytic cracking in a fluidized bed). The desulfurization (hydrodesulfurization) of gasolines and primarily FCC gasolines therefore has an obvious importance for achieving the specifications.

The pretreatment by hydrotreatment (hydrodesulfurization) of the feedstocks sent to the catalytic cracking leads to FCC gasolines that typically contain less than 100 ppm of sulfur. These hydrotreatment units operate, however, under rigorous temperature and pressure conditions, which assumes a significant consumption of hydrogen and a high level of investment. In addition, the entire feedstock is to be desulfurized, which leads to the treatment of very large volumes of feedstock.

It is therefore necessary, so as to meet the specifications of sulfur, to post-treat the catalytic cracking gasolines by hydrotreatment (or hydrodesulfurization). When this post-treatment is carried out under conventional conditions known to one skilled in the art, it is possible also to reduce the sulfur content of the gasoline. However, this process exhibits the major drawback of resulting in a very significant drop in the octane number of the fraction because of the saturation of olefins during hydrotreatment.

U.S. Pat. No. 4,131,537 teaches the advantage of fractionating the gasoline into several fractions, preferably three, based on their boiling points, and of desulfurizing them under conditions that can be different and in the presence of a catalyst that comprises at least one metal of group VIB and/or of group VIII. It is indicated in this patent that the larger benefit is obtained when the gasoline is fractionated into three fractions and when the fraction that has intermediate boiling points is treated under mild conditions.

The French Patent FR 2 785 908 teaches the advantage of fractionating the gasoline into a light fraction and a heavy fraction and then of carrying out a specific hydrotreatment of the light gasoline on a nickel-based catalyst and a hydrotreatment of the heavy gasoline on a catalyst that comprises at least one metal of group VIII and/or at least one metal of group VIb.

The U.S. Pat. No. 6,440,299 describes a process for elimination of the mercaptans of a hydrocarbon feedstock using a catalytic distillation column. The catalytic bed of the column is located above the supply so as to treat only the light fraction of the feedstock. The catalyst that is used is a catalyst with a nickel-sulfide-based substrate on which the elimination of mercaptans is done by a thioetherification reaction by addition to the diolefins. However, this process makes it difficult to obtain sulfur contents in the light fraction of the treated gasoline that meet the most stringent environmental standards (50 ppm by weight, and even 30 or 10 ppm by weight in certain countries). Actually, when the quantity of diolefins in the feedstock is low and/or the quantity of mercaptans is large, the kinetics of the conversion of the mercaptans in the catalyst is made difficult. To keep conversion at a high level, it is necessary either to increase the temperature or to limit the internal traffic in the column. Operating at an elevated temperature at a fraction iso-point of light gasoline can be done only via an increase in the pressure in the column that is, however, limited by the design of the column. Limiting the internal traffic (by lowering, for example, the internal reflux rate) exhibits the drawback of degrading the separating power of the column and consequently the recovery of light mercaptans that are not converted in the light fraction.

The U.S. Pat. No. 7,638,041 describes a process for desulfurization of an FCC gasoline fraction that uses a first catalytic distillation column that incorporates a reaction zone that contains a thioetherification catalyst. The catalyst makes possible the conversion of mercaptans into thioethers by reacting with the diolefins. The distillation column is operated in such a way as to separate:

- At the top of the column, a light gasoline from which mercaptans are removed,
- By a drain located below the reaction section, with a so-called "intermediate" gasoline containing diolefins,
- At the bottom of the column, a so-called "heavy" gasoline that contains the sulfur-containing compounds including the thioethers produced by thioetherification.

With regard to the intermediate gasoline, it can then be treated in a second distillation column comprising a bed of catalysts for selective hydrogenation of diolefins into olefins. From the top of the second distillation column, a light fraction of the intermediate gasoline that is recycled in the first distillation column is then recovered.

The conversion of the light mercaptans in the process of U.S. Pat. No. 7,638,041 can be problematic. Actually, the elimination of mercaptans is done by addition to the light diolefins of the feedstock (with the other diolefins being at least partially hydrogenated on the hydrogenation catalyst). However, it is known that the catalysts that are based on metal oxide of group VIII also catalyze the selective hydrogenation of diolefins. The two reactions are therefore concurrent on the light diolefins, and the result is a limited conversion of thioetherification of the lightest mercaptans, which are thereby entrained into the light gasoline at the top of the column.

One object of the invention is therefore to propose a process for production of a light gasoline with a very low sulfur content, i.e., having a sulfur content that is less than 50 ppm by weight and preferably less than 30 ppm or 10 ppm by weight, while limiting the octane number loss, which is also relatively simple and which requires an investment that is the smallest possible.

SUMMARY OF THE INVENTION

For this purpose, a process for treatment of a gasoline that comprises diolefins, olefins, and sulfur-containing compounds including mercaptans is proposed, in which:

- Gasoline is injected into a distillation column comprising at least one reaction zone including at least a first catalyst that comprises a substrate and at least one element of group VIII, with the injection being carried out at a level that is located below the reaction zone, in such a way as to bring into contact at least one fraction of the gasoline with the catalyst of the reaction zone and to transform at least a portion of the mercaptans of said fraction into sulfur-containing compounds by reaction with the diolefins, and to produce a desulfurized light gasoline that is drawn off at the top of said distillation column;

with the process also comprising the following stages:

An intermediate gasoline fraction is drawn off at a level located above the reaction zone and below the top of the distillation column;

A heavy gasoline that comprises the majority of the sulfur-containing compounds is drawn off at the bottom of the column;

Said intermediate gasoline fraction is brought into contact, in a demercaptization reactor, optionally with hydrogen, in the presence of a second catalyst in sulfide form comprising a substrate, at least one element selected from group VIII, and at least one element selected from group VIB, with the element content of group VIII being between 1 and 30% by weight of oxide relative to the total weight of the catalyst, and the element content of group VIB being between 1 and 30% by weight of oxide relative to the total weight of the catalyst in such a way as to produce an effluent that contains sulfides;

The effluent that is obtained from the demercaptization reactor is recycled in the distillation column.

The process according to the invention comprises a stage for treatment of the gasoline in a distillation column that is provided with a reaction zone that comprises a catalyst that is capable of making the mercaptans react with the diolefins that are present in the gasoline that is to be treated so as to form thioethers.

The reaction zone is placed in an upper portion of the distillation column in such a way that the light mercaptans, which are entrained with the gasoline that distills at the top of the distillation column, are brought into contact with the diolefins for forming thioethers that are consequently entrained into the bottom of the column.

When the light gasoline fraction distilling at the top of the column is brought into contact in the presence of hydrogen, the catalyst of the reaction zone (4) according to the invention makes it possible to hydrogenate the diolefins selectively and to isomerize the olefins whose double bond is in external position and internal position. The reaction for selective hydrogenation of the diolefins into olefins is quite especially important when the light fraction of the gasoline is used as a feedstock of an etherification unit (for example, for the production of tert-amyl methyl ether (TAME)) because these highly unsaturated compounds easily form gums in this type of process. When this light fraction is sent directly to the gasoline pool, it is also advantageous to hydrogenate the diolefins because the latter have a tendency to produce gums when the oxygen returns to the storage tanks.

The process according to the invention also implements a stage in which a fraction of intermediate gasoline is drawn off above the reaction section so as to treat the residual light mercaptans that have not been converted into thioethers in the distillation column by making them react with the olefins of said intermediate fraction in a reactor that is dedicated to this purpose. This "demercaptization" reaction is performed:

Primarily by direct addition of the mercaptans to the double bond of olefins for producing sulfides;

Or, but in a minority fashion, by hydrogenolyzing means: the hydrogen that is present in the reactor produces, by contact with a mercaptan, $H_2S$ that will then be added to the double bond of an olefin for forming a heavier mercaptan.

The level of conversion of mercaptans in the demercaptization reactor is very high (>90% and very often >95%) because the demercaptization reactions are performed selectively on the olefins that are present with high contents in the intermediate fraction.

The effectiveness of the conversion of mercaptans is connected in particular to the presence of a mercaptan/olefin ratio in the intermediate gasoline fraction that is very favorable for the demercaptization reaction (this ratio in general being higher than the one of the gasoline that is to be treated).

According to the invention, the effluent that is obtained from the demercaptization reactor is then recycled in the distillation column in such a way as to recover the sulfides and the heavy mercaptans thus formed via the gasoline that is drawn off at the bottom of the distillation column. The heavy gasoline reaction that is recovered at the bottom of the column can then be treated in a dedicated hydrodesulfurization unit.

According to the invention, the draw-off of the intermediate fraction, above the reaction section, can be a liquid draw-off carried out on a plate of the column or a vapor draw-off carried out between two plates. In the event of a liquid draw-off, a simple recirculation pump will make it possible to direct the intermediate gasoline fraction toward the reactor and to ensure the recycling.

The liquid draw-off of the intermediate gasoline fraction is particularly advantageous in the event of failed conversion of mercaptans solubilized in the liquid phase, due to, for example, competition between the hydrogenation of diolefins and thioetherification.

In the event of a vapor draw-off, the intermediate gasoline that is drawn off is preferably condensed by a condenser before being treated in the demercaptization reactor in which the catalytic reaction is carried out preferably in the liquid phase. The vapor draw-off from the intermediate gasoline fraction is particularly advantageous in the event of failed conversion of the lightest mercaptans, including in particular methanethiol or ethanethiol. If the feedstock comprises a large concentration of these light mercaptans, the latter are converted with difficulty by thioetherification in the reaction zone (4) because they are entrained in the vapor phase throughout separation stages in such a way that they do not encounter the thioetherification catalyst that works in the presence of a liquid hydrocarbon phase.

It should be emphasized that in the event that $H_2S$ is present in the feedstock, the latter is converted into mercaptan for recombination by the catalyst used in the catalytic column according to the invention by contact with the double bonds of diolefins, and even olefins. These recombination mercaptans are then converted into sulfides by addition to the olefins of the intermediate gasoline fraction by the action of the catalyst of the demercaptization reactor. These sulfide-type compounds, whose boiling points are higher than the starting recombination mercaptans, are then entrained in the heavy gasoline fraction drawn off at the bottom of the column after recycling.

The advantage of the process according to the invention is therefore to produce very high desulfurization rates for the light gasoline fraction despite the presence of $H_2S$ in the feedstock owing to the demercaptization reactor and the recycling of its effluents.

Another advantage of the process according to the invention is that the conversion of mercaptans in the distillation column by addition to the diolefins of the feedstock induces a significant increase of the molar ratio between olefins and mercaptans in the intermediate gasoline fraction in such a way that the effectiveness of the demercaptization in the subsequent stage is also improved because of the presence of a favorable olefin/mercaptan ratio.

Another advantage of the process according to the invention resides in the fact that it is not necessary to desulfurize the light gasoline that is recovered at the top of the distillation column because a major portion of the lightest sulfur-containing compounds is transformed into compounds of higher molecular weight in such a way that they are entrained in the heavy gasoline fraction. The absence of a stage for desulfurization of the light gasoline makes it possible to preserve the lightest olefins and thus to limit the octane number loss connected to an at least partial hydrogenation of olefins.

It should be emphasized that the catalytic hydrogenation reactions are not required for using the demercaptization reactor in the process according to the invention. Thus, the hydrogen that can be added is used essentially to maintain a hydrogenating surface state of the catalyst so as to ensure a high yield in the demercaptization reactions. Thus, another advantage of the process is that the two stages can be carried out at the same pressure (reduced by the pressure drop due to the hydraulic circuit) because the demercaptization stage requires only a small amount of dissolved hydrogen, and even none at all.

Another advantage of the process according to the invention is that the hydrogen that is optionally added to the demercaptization reactor can come from a recycling of the hydrogen that is recovered at the top of the distillation column when hydrogen is used in the distillation column.

Another advantage of the process according to the invention is connected to the flexibility offered by the coupling of the catalytic column and the demercaptization reactor in combination with a recycling of effluents in the column. Actually, owing to the process according to the invention, it is possible, for example, to increase the internal liquid-vapor traffic in the column for improving its separating power while maintaining a high overall conversion of mercaptans. Actually, the reactor can be operated under operating conditions that make it possible to compensate for the decrease in yield of mercaptan transformation by thioetherification in the column.

The presence of the reactor makes it possible to improve the separating power of the column as well as the performances for desulfurization of the light gasoline fraction without having to modify existing columns (e.g., addition of plates or of particular internals). Thus, the process according to the invention is less sensitive to the variations of the quality or of the flow rate of the feedstock that is to be treated (for example, the quantity of mercaptans to be converted) than a catalytic column that is used alone.

BRIEF DESCRIPTION OF THE DRAWINGS

These aspects as well as other aspects of the invention will be clarified in the detailed description of particular embodiments of the invention, with reference being made to drawings of the figures, in which.

In general, similar elements are denoted by identical references in the figures.

DETAILED DESCRIPTION OF THE INVENTION

Figure 1:
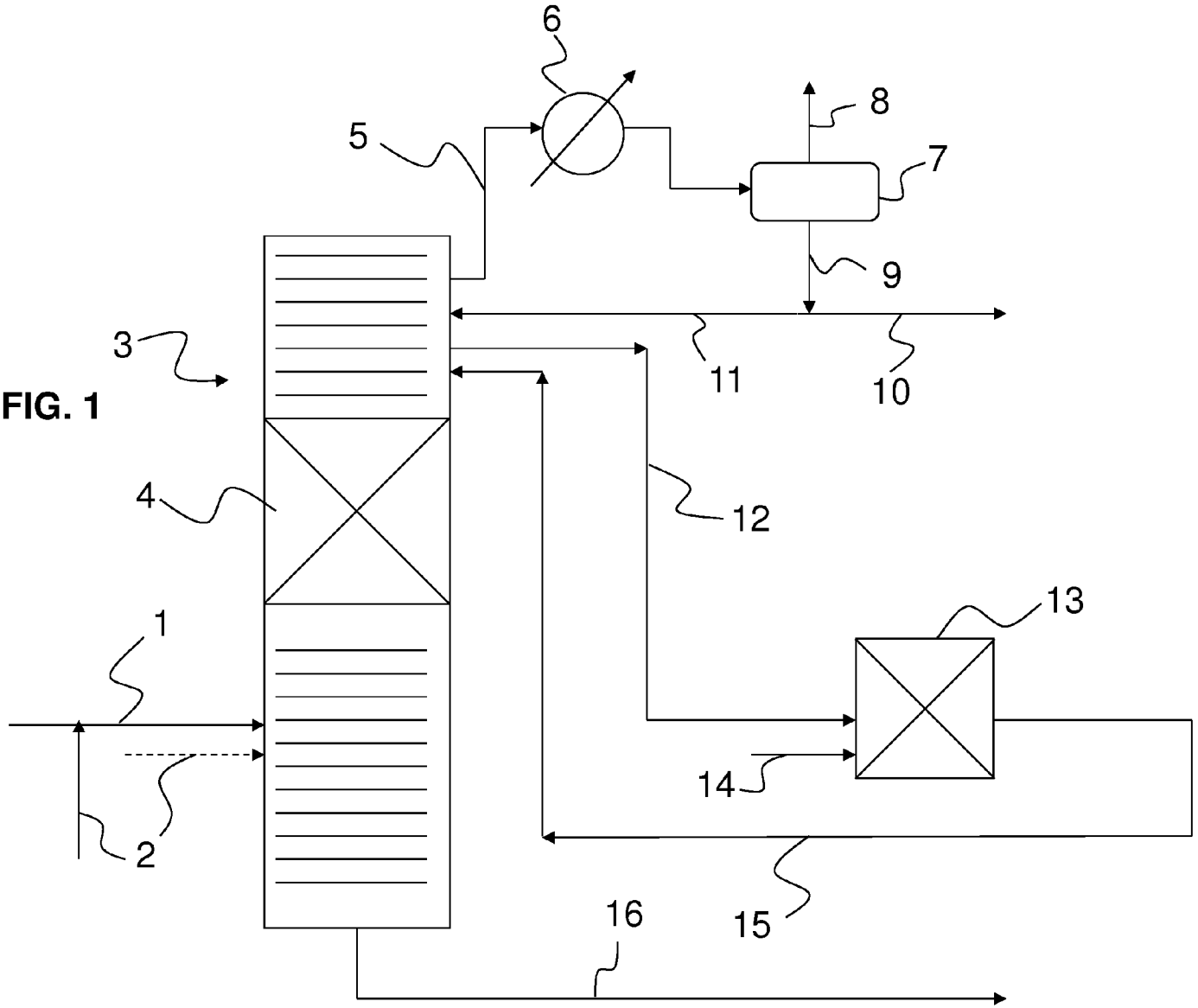
FIG. 1 shows a first simplified diagram of the process according to the invention.

This invention has as its object a process for the production of a light fraction of a gasoline that has a low sulfur content starting from a gasoline, preferably obtained from a unit for catalytic cracking, coking, or visbreaking.

This series of stages makes it possible ultimately to obtain a light fraction whose sulfur content was lowered without significant reduction of the olefin content, even for high conversion rates, without it being necessary to treat this light gasoline by means of a hydrodesulfurization section or to have recourse to processes making it possible to restore the octane number of the gasoline.

The process according to the invention thus makes it possible to provide a light gasoline fraction whose total sulfur content is less than 50 ppm by weight, preferably less than 30 ppm, and even less than 10 ppm by weight.

Within the framework of this application, the expression "catalytic column" refers to a piece of equipment in which the catalytic reaction and the separation of the products takes place at least simultaneously. The piece of equipment that is used can comprise a distillation column that is equipped with a reaction section comprising a catalyst bed and in which the reaction section is arranged between two sections comprising plates. It can also involve a distillation column combined with at least one reactor arranged inside said column and on a wall of the latter. The internal reactor can be operated as a vapor-phase reactor or as a liquid-phase reactor with a co-current or counter-current liquid/vapor circulation.

The use of a catalytic distillation column has as advantages—relative to the implementation of a system comprising a reactor and a distillation column—the reduction of the number of individual elements, hence a lower investment cost. The use of a catalytic column makes possible a control of the reaction while promoting an exchange of the heat that is released; the reaction heat can be absorbed by the heat for evaporation of the mixture.

The Gasoline to be Treated

The process according to the invention makes it possible to treat any type of gasoline fraction that contains sulfur and whose range of boiling points typically extends from approximately the boiling points of hydrocarbons with 2 or 3 carbon atoms (C2 or C3) up to approximately 250° C., preferably from approximately the boiling points of hydrocarbons with 2 or 3 carbon atoms (C2 or C3) up to approximately 220° C., and in a more preferred manner from approximately the boiling points of hydrocarbons with 5 carbon atoms up to approximately 220° C. The process according to the invention can also treat feedstocks having final points that are lower than those mentioned above, such as, for example, a C5 fraction−180° C.

In general, the sulfur contents of the entire gasoline fraction able to be treated, in particular those coming from FCC, are greater than 100 ppm by weight, and most of the time they are greater than 500 ppm by weight. For gasolines having final points of greater than 200° C., the sulfur contents are often higher than 1,000 ppm by weight; they can even, in some cases, reach values on the order of 4,000 to 5,000 ppm by weight.

Furthermore, the gasolines that are obtained from catalytic cracking units contain, on average, between 0.5% and 5% by weight of diolefins, between 20% and 50% by weight of olefins, between 10 ppm and 0.5% by weight of sulfur, including in general less than 300 ppm of mercaptans. The mercaptans in general are concentrated in light fractions of gasoline and more specifically in the fraction whose boiling point is less than 120° C.

It should be noted that the sulfur-containing compounds that are present in the gasoline can also comprise heterocyclic sulfur-containing compounds, such as, for example, thiophenes, alkylthiophenes, or benzothiophenes.

With reference to FIG. 1, the gasoline that is to be treated is sent via the pipe 1 optionally mixed with the hydrogen that is provided via the pipe 2 into a distillation column 3 incorporating a catalytic reaction zone 4 arranged in the upper section of the distillation column 3. The gasoline that is to be treated, mixed with the hydrogen, is introduced into a section of the column located below the reaction zone 4. It should be noted that alternatively, the hydrogen is not mixed with the gasoline to be treated but is introduced directly into the column, as shown by the line 2 in dotted form.

According to the invention, the catalyst that is used in the reaction zone 4 comprises at least one element of group VIII (groups 8, 9 and 10 of the new periodic classification, Handbook of Chemistry and Physics, 76$^{th}$ Edition, 1995-1996) deposited on a porous substrate and may originally be in the form of small-diameter extrudates or spheres. The catalyst has a structural shape that is suitable for catalytic distillation so as to act both as a catalytic agent for carrying out the reactions but also as a material transfer agent so as to have separation stages available throughout the bed. The catalyst according to the invention is capable of catalyzing the reaction for adding mercaptans (RSH) to the diolefins so as to form thioether-type compounds whose molecular weight is greater than the starting mercaptan. Typically, the mercaptans that can react with the diolefins are methyl mercaptans, ethyl mercaptan, n-propyl mercaptan, isopropyl mercaptans, isobutyl mercaptans, tert-butyl mercaptans, and n-butyl mercaptans.

In a preferred manner, the catalyst that is used in the reaction zone 4 is also capable of selectively hydrogenating the diolefins and optionally isomerizing the olefins whose double bond is in an external position into an isomer whose double bond is in the internal position.

According to a preferred embodiment, the element of group VIII can be selected from among nickel and palladium. If the element is palladium, it is preferably the only active metal in the catalyst and is present at a content by weight of palladium relative to the total weight of catalyst of between 0.1 and 2%.

When the element is other than palladium, for example nickel, the content by weight of the element of group VIII, expressed in terms of oxide, is generally between 10 and 60% relative to the total weight of catalyst.

The porous substrate of the catalyst can be selected from among alumina, nickel aluminate, silica, silicon carbide, or a mixture of these oxides. In a preferred manner, alumina—and in an even more preferred manner, pure alumina—is used.

A catalyst that is particularly well suited for carrying out the addition of mercaptans to the diolefins and a selective hydrogenation of diolefins comprises 40 to 60% by weight of nickel oxide relative to the total weight of catalyst, deposited on an alumina substrate.

According to the process of the invention, at least three fractions are drawn off from the column:

- A so-called "light" fraction that distills at the top of the column,
- An intermediate fraction that is drawn off from the column at a point that is located above the reaction zone and below the draw-off point of the light fraction,
- A "heavy" fraction that is recovered at the bottom of the column whose boiling point is higher than that of the light fraction and that of the intermediate fraction and that combines the heaviest sulfur-containing compounds such as heavy mercaptans, thiophenes, thioethers and disulfides.

The gasoline fraction that distills toward the reaction zone 4—in general containing the lightest olefins that have the higher octane numbers and mercaptans, such as, for example, the methyl mercaptans, ethyl mercaptan, n-propyl mercaptan, isopropyl mercaptans, isobutyl mercaptans, tert-butyl mercaptans, and n-butyl mercaptans—is brought into contact with the catalytic bed of the reaction zone 4. In this zone, the reaction of adding mercaptans with the diolefins that also distill with this fraction is performed so as to produce thioethers. The thus generated thioether products have boiling points that are higher than that of the starting mercaptans such that they are separated and entrained in the "heavy" fraction at the bottom of the catalytic distillation column.

The operating pressure of the catalytic distillation column is in general between 0.4 and 5 MPa, preferably between 0.6 and 2 MPa, and in a preferred manner between 0.6 and 1 MPa. The temperature that prevails in the reaction zone is in general between 50 and 150° C., preferably between 80 and 130° C.

In the reaction zone 4, when hydrogen is used, the hydrogen/diolefin molar ratio is in general between 1 and 10 mol/mol. It is preferable, however, to operate in the presence of a small excess of hydrogen relative to the diolefins, preferably with a hydrogen/diolefin molar ratio of between 1 and 3 mol/mol, so as to prevent too significant a hydrogenation of the olefins and to ensure a good octane number.

With reference to FIG. 1, a light gasoline that is desulfurized is recovered at the top of the distillation column via the line 5. In a preferred way, the light gasoline fraction is drawn off from several plates below the top of the catalytic distillation column 3 for stabilizing it before cooling it.

The desulfurized light gasoline fraction typically has a boiling point in the range going from C2 compounds to C5 or C6 compounds and has a sulfur content that is less than 50 ppm or 30 ppm, and even 10 ppm by weight.

For example, the distillation column is configured for operating as a depentanizer, i.e., it makes it possible to recover a light gasoline that comprises compounds having 2 to 5 carbon atoms at the top of the column.

Alternatively, the distillation column operates as a dehexanizer, i.e., it makes it possible to recover a light gasoline that comprises compounds having 2 to 6 carbon atoms at the top of the column.

In accordance with FIG. 1, the light gasoline is then condensed by means of a heat exchanger 6 and is sent into a separator tank 7. The unconsumed hydrogen is recovered at the top of said separator tank via the line 8, optionally to be recycled in the column and/or in the demercaptization reactor, and the liquid desulfurized light gasoline is drawn off at the bottom of the tank via the line 9. The desulfurized liquid gasoline is then divided into first and second portions, with the first portion being sent to, for example, the gasoline pool or as a feedstock of another unit via the line 10, while the second portion is recycled via the line 11 in the distillation column 3 for ensuring a reflux in the latter.

According to the invention, the distillation column is configured in such a way as to also make possible a draw-off of an intermediate gasoline fraction carried out at a level located between the reaction zone 4 and the draw-off point of the light gasoline fraction.

According to a first embodiment, the draw-off is done on a plate located above the catalytic bed of the column in such a way as to recover a liquid-phase gasoline. For example, the draw-off takes place on the first or second plate, and even the third plate, located above the catalytic bed. According to this embodiment, the intermediate gasoline is therefore a liquid-phase gasoline that contains solubilized residual mercaptans that have not reacted on the diolefins in the reaction zone 4 and optionally thiophenic-type compounds. As indicated in FIG. 1, the intermediate gasoline is then sent into a demercaptization reactor 13 optionally with the hydrogen provided via the pipe 14.

According to another embodiment, the draw-off is done in such a way as to recover an intermediate vapor-phase gasoline. In a preferred manner, this draw-off is done between the catalytic bed and the first plate located above the latter, or then between the first and second plates located above the catalytic bed or else between the second and third plates located above the catalytic bed. According to this other embodiment, the intermediate gasoline is therefore a gasoline that contains residual light mercaptans in the vapor phase that have not reacted in the reaction zone.

Figure 2:
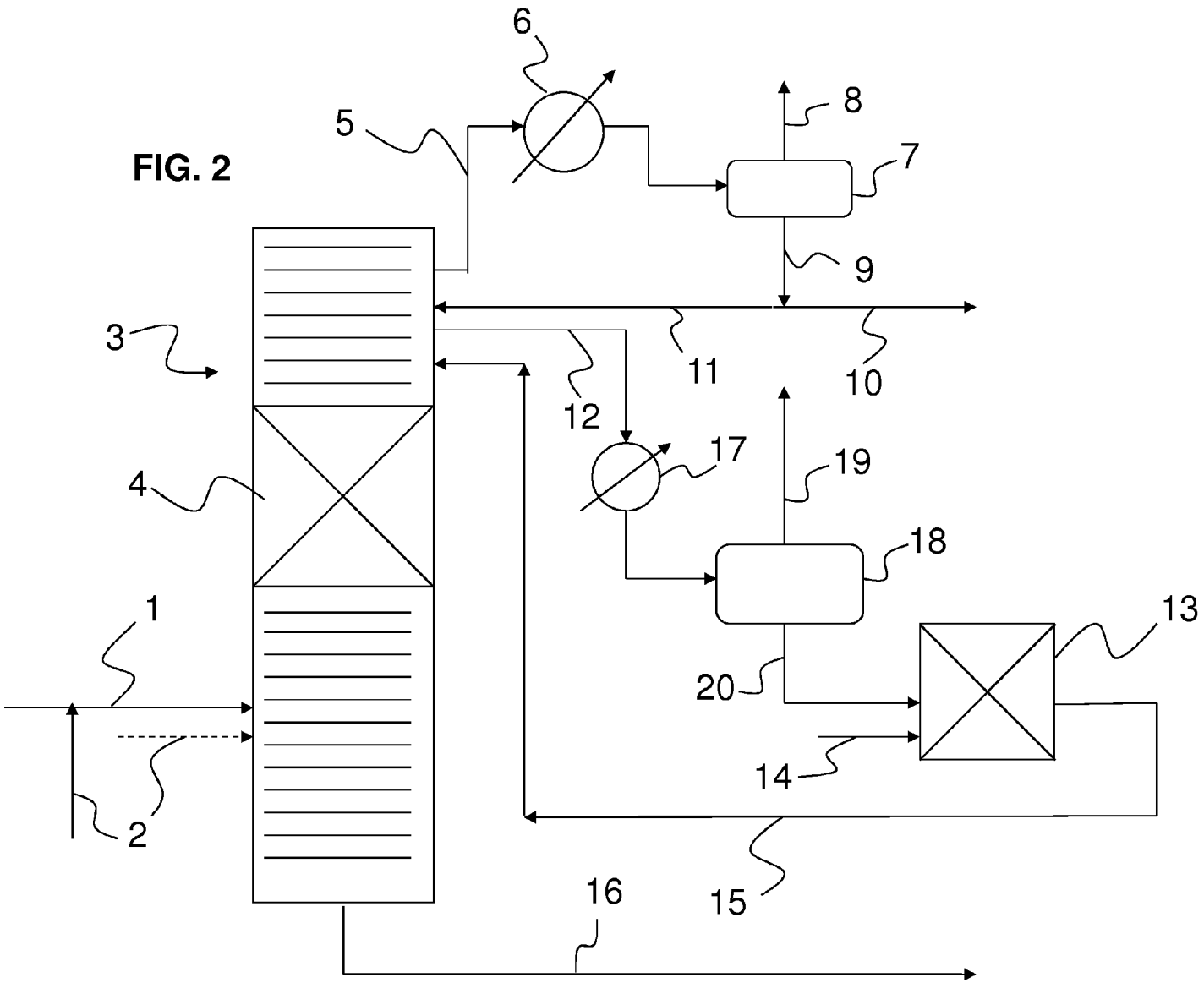
FIG. 2 shows a second simplified diagram of the process according to the invention.

As indicated in FIG. 2, the intermediate gasoline under vapor phase is preferably first condensed by means of the condenser 17 and then recovered at the bottom of the separator tank 18 to be sent thanks to a recirculation pump (not shown) via the line 20 into a demercaptization reactor 13 with the hydrogen provided via the pipe 14. The vapor line 19 located at the top of the separator tank 18 comprises hydrogen for the most part and several other incondensable products obtained from the vapor draw-off from the column. This hydrogen is preferably reinjected into the column at a location close to the draw-off point so as not to disrupt the hydrodynamics or optionally is combined with the top gases of the column coming from line 8. Alternatively, the hydrogen that is obtained from the separator tank 18 is recycled in the demercaptization reactor 13. In the two cases, the hydrogen that has not reacted in the process according to the invention is sent in a preferred manner to a loaded recycling compressor for recycling hydrogen to the column 3 and/or the demercaptization reactor 13.

The catalyst that is used for carrying out the reactions for addition of residual mercaptans to the olefins in the reactor 13 is a catalyst in sulfide form comprising a substrate, at least one element selected from group VIII (groups 8, 9 and 10 of the new periodic classification Handbook of Chemistry and Physics, $76^{th}$ Edition, 1995-1996) and at least one element that is selected from group VIB of the periodic table (group 6 of the new periodic classification Handbook of Chemistry and Physics, $76^{th}$ Edition, 1995-1996). According to the invention, the element content of group VIII is between 1 and 30% by weight of oxide relative to the total weight of the catalyst, and the element content of group VIB is between 1 and 30% by weight of oxide relative to the total weight of the catalyst. The element of group VIII is preferably selected from among nickel and cobalt, and in particular nickel. The element of group VIB is preferably selected from among molybdenum and tungsten, and in a very preferred manner molybdenum.

To be active, the metal elements that constitute the catalyst of the demercaptization reactor are sulfurized. Within the framework of this invention, it is considered that an element is sulfurized when the molar ratio between the sulfur (S) that is present in the catalyst and said element is at least equal to 60% of the theoretical molar ratio corresponding to the total sulfurization of the element being considered:

$$(S/element)_{catalyst} \geq 0.6 \times (S/element)_{theoretical}$$

with:

$(S/element)_{catalyst}$=molar ratio between the sulfur (S) and the element that are present in the catalyst, $(S/element)_{theoretical}$=molar ratio between sulfur and the element corresponding to the total sulfurization of the sulfide element.

This theoretical molar ratio varies according to the element being considered:

$(S/Fe)_{theoretical}=1$ $(S/Co)_{theoretical}=8/9$ $(S/Ni)_{theoretical}=2/3$ $(S/Mo)_{theoretical}=2/1$ $(S/W)_{theoretical}=2/1$ The substrate of the catalyst is preferably selected from among alumina, nickel aluminate, silica, silicon carbide, or a mixture of these oxides. In a preferred manner, alumina is used, and in an even more preferred manner, pure alumina is used. In a preferred manner, a substrate that has a total pore volume measured by mercury porosimetry of between 0.4 and 1.4 $cm^3/g$—and preferably between 0.5 and 1.3 $cm^3/g$—is used. The specific surface area of the substrate is preferably between 70 $m^2/g$ and 350 $m^2/g$. According to a preferred variant, the substrate is a cubic gamma-alumina or delta-alumina. The catalyst used in stage a) in general comprises:

- A content by weight of oxide of the element of group VIB of between 1 and 30% by weight relative to the total weight of the catalyst,
- A content by weight of oxide of the element of group VIII of between 1 and 30% by weight relative to the total weight of the catalyst,
- A sulfurization rate of the metals constituting said catalyst that is at least equal to 60%,
- A molar ratio between the metal of group VIII and the metal of group VIB of between 0.6 and 3 mol/mol,
- A substrate that consists of gamma-alumina or delta-alumina with a specific surface area of between 70 $m^2/g$ and 350 $m^2/g$.

In particular, it was found that the performance levels are improved when the catalyst has the following characteristics:

- The content by weight of oxide of the element of group VIB in oxide form is between 4 and 20% by weight relative to the total weight of catalyst, preferably between 6 and 18% by weight;
- The metal content of group VIII expressed in oxide form is between 3 and 15% by weight and preferably between 4% by weight and 12% by weight relative to the total weight of catalyst;
- The molar ratio between the non-noble metal of group VIII and the metal of group VIB is between 0.6 and 3 mol/mol and in a preferred manner between 1 and 2.5 mol/mol,
- A substrate that consists of gamma-alumina with a specific surface area of between 180 $m^2/g$ and 270 $m^2/g$.

A preferred embodiment of the invention corresponds to the use of a demercaptization catalyst containing a content by weight of nickel oxide (in NiO form) of between 4 and 12%, a content by weight of molybdenum oxide (in $MoO_3$ form) of between 6% and 18%, and a nickel/molybdenum molar ratio of between 1 and 2.5, with the metals being deposited on a substrate that consists only of alumina having a specific surface area of between 180 $m^2/g$ and 270 $m^2/g$ and with the sulfurization rate of the metals constituting the catalyst being greater than 80%.

The reactions for adding residual mercaptans to the olefins in the demercaptization reactor 13 are in general carried out at a temperature of between 50 and 150° C., preferably between 80° C. and 130° C., at a pressure of between 0.4 MPa and 5 MPa, preferably between 0.6 MPa and 2 MPa, and in a preferred manner between 0.6 MPa and 1 MPa, with a liquid hourly space velocity (LHSV) of between 0.5 and 10 $h^{-1}$.

This stage can be carried out without adding hydrogen in the reactor, but in a preferred manner, the latter is injected with the feedstock in such a way as to maintain a hydrogenating surface state of the catalyst that is suitable for high levels of conversion of demercaptization. Typically, the demercaptization reactor operates with an $H_2$/HC ratio of between 0 and 10 $Nm^3$ of hydrogen per $m^3$ of feedstock, and in an even more preferred manner between 0.5 and 5 $Nm^3$ of hydrogen per $m^3$ of feedstock.

Heating the feedstock that is treated in the demercaptization reactor can be envisioned. However, the reaction temperature and pressure conditions in the demercaptization reactor 13 are in general governed by those of the intermediate gasoline, which is drawn off on the plate or between two plates. The different recirculation pumps are used only to carry out the draw-off and the recycling and do not have the purpose of setting a reactor pressure.

All or a portion of the gasoline that is obtained from the demercaptization reactor 13 is evacuated via the pipe 15 to be recycled in the distillation column 4. The objective of this recycling is to recover the sulfides and the heavy mercaptans formed in the demercaptization reactor 13 in the "heavy" gasoline that is evacuated at the bottom of the distillation column via the line 16. The recycling of the effluents of the reactor is to be carried out in such a way as to minimize its impact on the hydrodynamics and the thermal balance of the column. In a preferred manner, the recycling is carried out either on a distillation plate located just below or above the draw-off plate of the intermediate gasoline, or on the same plate as the draw-off plate.

EXAMPLES

Example 1

An FCC gasoline feedstock is sent into a catalytic column with a 5-cm diameter and a 12-m height. This column is charged in the upper part with a 3-m catalytic bed of a catalyst that contains approximately 0.3% by weight of Pd on the alumina-based substrate.

The characteristics of the feedstock are as follows:

| | |
|---|---|
| Starting Point (° C.) | 0 |
| Final Point (° C.) | 203 |
| Density | 0.755 |
| Paraffins (% by Weight) | 29.0 |
| Olefins (% by Weight) | 50.0 |
| Naphthenes (% by Weight) | 8.8 |
| Aromatic Compounds (% by Weight) | 12.2 |
| Sulfur Content (ppm) | 943 |
| Mercaptan Content (ppm) | 198 |

The operating conditions of the catalytic column are as follows:

Top pressure of the column: 0.9 MPa

Mean temperature of the catalytic bed: 130° C.

Feedstock flow rate: 39 kg/h

H2/HC: 2N liters/liters

A liquid intermediate fraction is drawn off on the plate located above the catalytic bed, and then analyzed. The results of the analyses of this product are provided in the following table:

| | |
|---|---|
| Starting Point (° C.) | 55 |
| Final Point (° C.) | 103 |
| Density | 0.704 |
| Yield Relative to the Mass Flow Rate of the Feedstock (%) | 29.0 |
| Olefins (% by Weight) | 35.4 |
| Sulfur Content (ppm) | 241 |
| Mercaptan Content (ppm) | 17 |

It is noted that the olefin/mercaptan ratio increased in this collected product relative to the starting feedstock.

Example 2

1,000 $cm^3$ of a catalyst in the form of spheres with a diameter of 2-4 mm and having a content of 8% by weight of NiO and 8% by weight of $MoO_3$ relative to the total weight of catalyst, on an alumina substrate, is loaded into a fixed-bed reactor with downward flow. Before the implementation, the catalyst is sulfurized in advance by injection for 4 hours at VVH=2 $h^{-1}$, at 350° C., and at a pressure of 2.5 MPa, of a heptane feedstock containing 4% DMDS under a hydrogen flow rate at 500 N liters/liters. Under these conditions, the DMDS is broken down into $H_2S$ and makes possible the sulfurization of the catalyst.

The intermediate gasoline fraction that is recovered as described in Example 1 is then treated in the reactor under the following operating conditions:

P=1.1 MPa

T=119° C.

VVH=3 $h^{-1}$ $H_2$/HC=2 N liters/liters

The effluent that is obtained from the reactor is analyzed, and the results are provided in the following table:

| | |
|---|---|
| Olefins (mol %) | 35.2 |
| Sulfur Content (ppm) | 241 |
| Mercaptan Content (ppm) | <0.1 |

After passage in this demercaptization reactor, it is noted that the mercaptans of the intermediate fraction have been converted into sulfides, whereas the olefins have been very sparingly hydrogenated.

Example 3

The series of stages described in FIG. 1 was reproduced. Thus, the feedstock of Example 1 was treated under the same conditions as those of Example 1. The liquid intermediate gasoline drawn off from the column is treated in the demercaptization reactor in accordance with Example 2. The entire effluent obtained from the demercaptization reactor is recycled in the column at the draw-off point of the intermediate gasoline.

The top gasoline fraction was analyzed, and the results are provided in the following table:

| | |
|---|---|
| Yield (% by Weight Relative to the Total Weight of the Treated Gasoline) | 26.2 |
| Starting Point (° C.) | −1.1 |
| Final Point (° C.) | 63.2 |
| Olefin Content (% by Weight) | 59.3 |
| Sulfur Content (ppm by Weight) | 8 |
| Mercaptan Content (ppm) | 1 |

The gasoline fraction that is recovered at the top of the column has a total sulfur content of less than 10 ppm, with a small proportion of mercaptans. Furthermore, it is noted that the catalysts used in the column have not affected the olefin content of the light gasoline fraction.

The entire disclosures of all applications, patents and publications, cited herein and of corresponding French application Ser. No. 13/00065, filed Jan. 14, 2013 are incorporated by reference herein.

The invention claimed is:

1. Process for treatment of a gasoline comprising diolefins, olefins, and sulfur-containing compounds including mercaptans, in which:

Gasoline is injected into a distillation column (3) comprising at least one reaction zone (4) including at least a first catalyst comprising a substrate and at least one element of group VIII, with the injection being carried out at a level located below the reaction zone (4), in such a way as to bring into contact at least one fraction of the gasoline with the catalyst of the reaction zone (4) and to transform at least a portion of the mercaptans of said fraction into sulfur-containing compounds by reaction with the diolefins and to produce a desulfurized light gasoline that is drawn off at the top of said distillation column (3); with the process also comprising the following stages:

An intermediate gasoline fraction is drawn off at a level located above the reaction zone (4) and below the top of the distillation column (3);

A heavy gasoline comprising the majority of the sulfur-containing compounds is drawn off at the bottom of the column;

In a demercaptization reactor (13), said intermediate gasoline fraction is brought into contact optionally with hydrogen, in the presence of a second catalyst in sulfide form comprising a substrate, at least one element selected from group VIII and at least one element selected from group VIB, with the element content of group VIII being between 1 and 30% by weight of oxide relative to the total weight of catalyst, the element content of group VIB being between 1 and 30% by weight of oxide relative to the total weight of the catalyst in such a way as to produce an effluent that contains sulfides;

The effluent that is obtained from the demercaptization reactor is recycled in the distillation column (3).

2. Process according to claim 1, in which the draw-off of the intermediate gasoline fraction in the liquid phase is carried out on a plate located above the reaction zone (4).

3. Process according to claim 1, in which the draw-off of the intermediate gasoline fraction in the vapor phase is carried out between two plates located above the reaction zone (4).

4. Process according to claim 1, in which the first catalyst comprises nickel with a content of between 10 and 60% by weight of nickel oxide relative to the total weight of catalyst.

5. Process according to claim 1, in which the first catalyst comprises palladium with a content of between 0.1 and 2% by weight of palladium metal relative to the total weight of catalyst.

6. Process according to claim 1, in which the bringing into contact of the gasoline fraction in the reaction section is done at a temperature of between 50 and 150° C. and at a pressure of between 0.4 and 5 MPa.

7. Process according to claim 1, in which the bringing into contact of the fraction of the gasoline in the reaction section is done in the presence of hydrogen.

8. Process according to claim 1, in which the second catalyst comprises nickel and molybdenum, with a content of between 1 and 30% by weight of nickel oxide relative to the total weight of catalyst and a content of between 1 and 30% by weight of molybdenum oxide relative to the total weight of catalyst.

9. Process according to claim 1, in which the distillation column is configured in such a way as to recover a light gasoline comprising compounds having 2 to 5 carbon atoms or a light gasoline comprising compounds having 2 to 6 carbon atoms at the top of the column (3).

10. Process according to claim 1, in which the stage for demercaptization of the intermediate gasoline is carried out at a temperature of between 50 and 150° C., and preferably between 80° C. and 130° C., at a pressure of between 0.4 MPa and 5 MPa, and preferably between 0.6 MPa and 2 MPa, and with a liquid hourly space velocity (LHSV) of between 0.5 and 10 $h^{-1}$.

11. Process according to claim 10, in which the pressure used in the demercaptization reactor is equal to the pressure of the intermediate gasoline drawn off from the column, reduced by the pressure drop due to the hydraulic circuit.

12. Process according to claim 1, in which a stage of condensation and separation is carried out on the light gasoline so as to recover unconsumed hydrogen.

13. Process according to claim 1, in which the heavy gasoline fraction is treated in a hydrodesulfurization unit.

* * * * *